US011724925B2

(12) United States Patent
Nava

(10) Patent No.: US 11,724,925 B2
(45) Date of Patent: Aug. 15, 2023

(54) MACHINE FOR PACKAGING LIQUIDS OR SEMISOLID PRODUCTS IN CONTAINERS

(71) Applicant: SMI S.P.A., Bergamo (IT)

(72) Inventor: Angelo Nava, Bergamo (IT)

(73) Assignee: SMI S.P.A., Bergamo (IT)

( * ) Notice: Subject to any disclaimer, the term of this patent is extended or adjusted under 35 U.S.C. 154(b) by 0 days.

(21) Appl. No.: 17/307,238

(22) Filed: May 4, 2021

(65) Prior Publication Data

US 2021/0339998 A1 Nov. 4, 2021

(30) Foreign Application Priority Data

May 4, 2020 (IT) ..... 102020000009685

(51) Int. Cl.

| | |
|---|---|
| ***B67C 7/00*** | (2006.01) |
| ***B65C 3/08*** | (2006.01) |
| ***B67C 3/24*** | (2006.01) |
| ***B67C 3/22*** | (2006.01) |

(52) U.S. Cl.

CPC ..... *B67C 7/004* (2013.01); *B65C 3/08* (2013.01); *B67C 3/24* (2013.01); *B67C 7/0073* (2013.01); *B67C 2003/227* (2013.01)

(58) Field of Classification Search

CPC ... B65B 3/022; B67C 2003/227; B67C 7/004; B67C 3/24; B67C 7/0073; B67C 3/22; B67C 7/00; B67C 7/002; B65C 3/08

USPC ..... 53/452

See application file for complete search history.

(56) References Cited

U.S. PATENT DOCUMENTS

| | | | | |
|---|---|---|---|---|
| 3,079,637 A * | 3/1963 | Marzillier | ..... | B29C 49/68 425/436 R |
| 4,445,549 A * | 5/1984 | Bernhard | ..... | B67C 3/22 141/148 |
| 5,105,859 A * | 4/1992 | Bennett | ..... | B67C 3/04 141/102 |

(Continued)

FOREIGN PATENT DOCUMENTS

| | | | | |
|---|---|---|---|---|
| DE | 202007017932 U1 | 10/2008 | | |
| EP | 1707530 A1 * | 10/2006 | ..... | B67C 3/22 |

(Continued)

OTHER PUBLICATIONS

Italian Search Report for related IT Patent Application No. 202000009685, dated Jan. 27, 2021, 2 Pages.

*Primary Examiner* — Mary E McManmon
*Assistant Examiner* — Christopher M Afful
(74) *Attorney, Agent, or Firm* — Armstrong Teasdale LLP

(57) ABSTRACT

Described herein are a machine for packaging liquids or semisolid products in containers, in particular liquids in containers such as bottles, and a support system of such a machine. In particular, the machine for packaging liquids in containers includes two or more operating units selected from a preform oven, a blowing unit for blowing the preforms to form containers, a rinsing unit for rinsing the blown containers, a container filling unit, a filled container capping unit, a container labeling unit, an empty or filled container sterilization unit, and a container descent and orientation unit; distribution starwheels for transporting the preforms or containers between the operating units; and a base including an upper plate and a lower plate, wherein all the operating units and the distribution starwheels are placed on the upper plate.

10 Claims, 5 Drawing Sheets

(56) References Cited

U.S. PATENT DOCUMENTS

| | | | | |
|---|---|---|---|---|
| 8,197,245 | B2 * | 6/2012 | Dordoni | B29C 49/46 425/522 |
| 2011/0085849 | A1 * | 4/2011 | Calzolari | B67C 3/22 403/292 |
| 2014/0318083 | A1 * | 10/2014 | Marastoni | B65G 65/00 53/561 |
| 2015/0274498 | A1 * | 10/2015 | Van Steen | B67C 3/008 53/453 |
| 2019/0256299 | A1 * | 8/2019 | Danel | B65G 47/846 |

FOREIGN PATENT DOCUMENTS

| | | | | |
|---|---|---|---|---|
| EP | 1707530 | A1 | 10/2016 | |
| EP | 3085628 | A1 * | 10/2016 | B67C 7/00 |
| EP | 3085628 | A1 | 10/2016 | |

* cited by examiner

MACHINE FOR PACKAGING LIQUIDS OR SEMISOLID PRODUCTS IN CONTAINERS

CROSS-REFERENCE TO RELATED APPLICATIONS

This application claims the benefit of priority to Italian Patent Application No. 102020000009685, filed May 4, 2020, the entire content and disclosure of which are hereby incorporated by reference herein.

FIELD OF THE INVENTION

The present invention relates to a machine for packaging liquids or semisolid products in containers, in particular liquids in containers such as bottles and to a support system of such a machine.

BACKGROUND ART

The packaging of liquid products, such as beverages or products for cleaning and hygiene, is carried out in special equipment or continuous systems which normally comprise the heating and blowing of the preforms to form the containers, the filling, capping and labeling thereof. These operations are often conducted in different machines dedicated to the various operations, connected by appropriate movement systems, and rarely in a single machine which carries out all the operations.

In any case, the various operating units are each placed on a base or support, often consisting of tubular elements or bars to form a frame, under which electrical cables and pipes for the various utilities of the machine extend.

The various bases of the operating units are then joined, normally by bolting, and adjusted in height, so as to create the operating unit of the machine.

This method of assembling a machine for packaging liquid products is not always optimal and has numerous disadvantages, including the considerable time required for the machine to be put into operation.

SUMMARY OF THE INVENTION

The object of the present invention is therefore a machine for packaging liquids in containers as defined in the appended claims, the definitions of which form an integral part of the present description.

An object of the invention is a machine for packaging liquids in containers, comprising:

- two or more operating units selected from a preform oven, a blowing unit for blowing the preforms to form containers, a rinsing unit for rinsing the blown containers, a container filling unit, a filled container capping unit, a container labeling unit, an empty or filled container sterilization unit, and a container descent and orientation unit;
- distribution starwheels for transporting the preforms or containers between the operating units;

characterized in that the machine comprises a base which comprises an upper plate and a lower plate, in which all the operating units and the support of the distribution starwheels are placed on said upper plate.

According to a preferred embodiment, the upper plate and the lower plate are assembled to form a box-like structure, the box-like structure comprising sides which separate the upper plate from the lower plate so as to enclose a space therein, configured to accommodate cables and pipes which are functional to the operation of the machine.

According to a preferred embodiment, the upper plate is larger than the lower plate, whereby it protrudes laterally with respect to the sides, in which fins extend at the corners of the box-like structure, the fins acting as a reinforcement for the ends of the upper plate and as abutment surfaces for support bars of the base.

According to a preferred embodiment, the box-like structure comprises one or more compartments which are open on the side of the lower plate and closed at the top by the upper plate and laterally by walls, the compartments being configured to accommodate and allow the passage of cables and pipes which are functional to the operation of the machine.

According to a preferred embodiment, the sides of the box-like structure and/or the walls of the compartments comprise openings configured to allow the passage of pipes and cables between the exterior and the interior of the box-like structure.

According to a preferred embodiment, the lower plate comprises a plurality of service openings, arranged in prefixed positions and configured to allow the torch of a welding machine or other tools required for fixing the operating units to the upper plate to access from below the lower surface of the upper plate.

According to a preferred embodiment, the upper plate comprises:

- fixing seats for the operating units and for the distribution starwheels, the fixing seats being arranged in a predefined position determined by the geometry of the machine, and
- a plurality of openings configured for the passage of cables and pipes which are functional to the operation of the machine.

According to a preferred embodiment, the base has a maximum size of 3 meters in width and/or 10 meters in length.

According to a preferred embodiment, the machine of the invention comprises, on said base, the following operating units:

- a preform oven, a blowing unit and distribution starwheels for moving the preforms or containers between said operating units, or
- a preform oven, a blowing unit, a filling unit, a labeling unit, and systems for transporting the containers between said operating units, in which said blowing unit comprises two to sixteen blowing modules.

Further features and advantages of the present invention will be apparent from the description of some examples of embodiment, given here by way of non-limiting example.

DETAILED DESCRIPTION OF THE INVENTION

Figure 1:
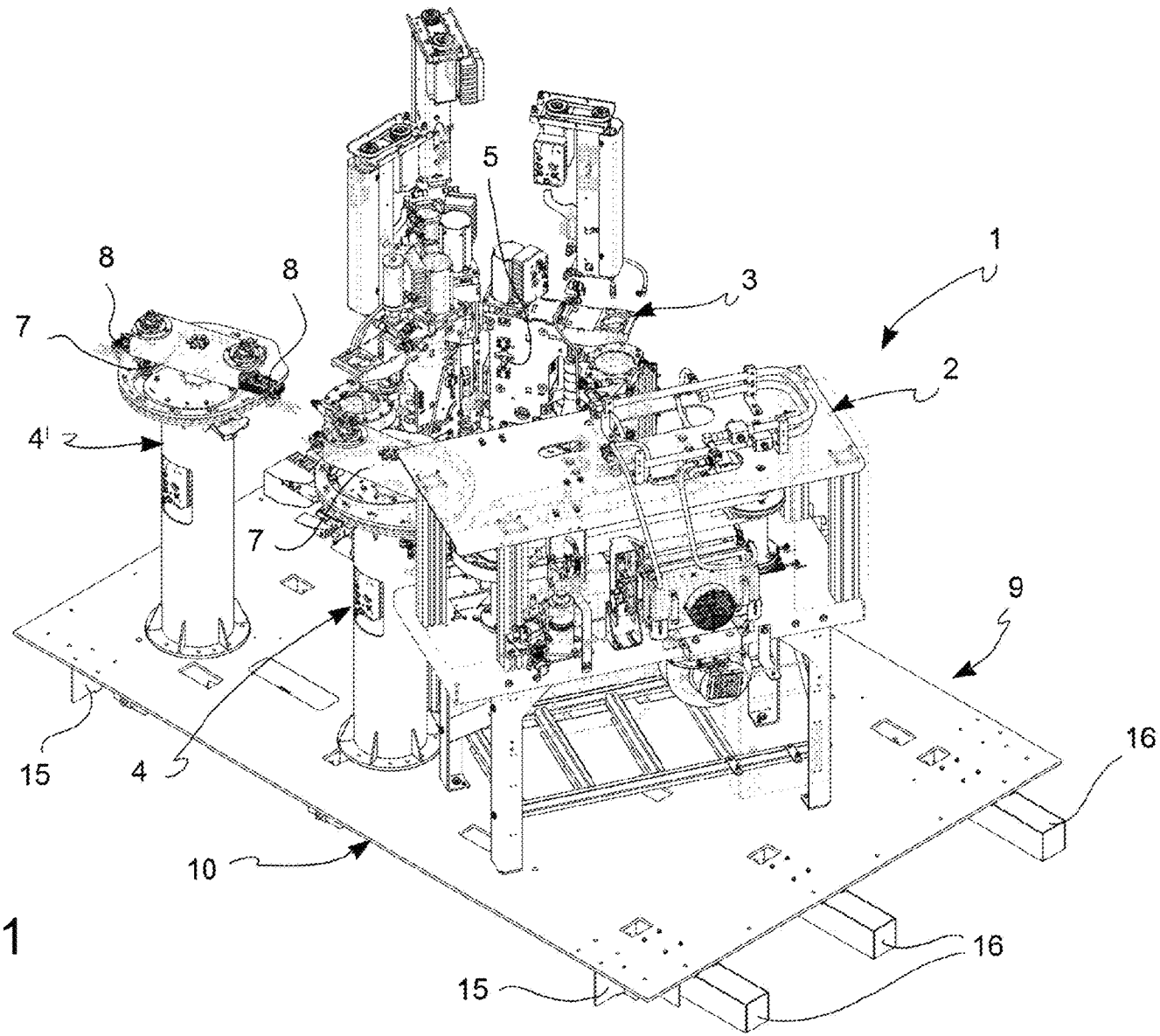
FIG. 1 depicts a perspective view of a machine according to the invention.

With reference to FIG. 1, reference numeral 1 indicates as a whole a machine for packaging liquids in containers, for example beverages in bottles. In particular, the machine 1 comprises exclusively a preform heating unit 2, normally referred to as a preform oven, and a blowing unit 3 for the heated preforms. The machine 1 further comprises distribution starwheels 4, 4' which, respectively, transfer the heated preforms from the oven 2 to the blowing unit 3 and the bottles blown by the blowing unit 3 to a subsequent downstream processing (not shown), which can typically comprise a rinsing unit, a bottle filling unit with liquid, a capping unit and a labeling unit. In certain embodiments, all or some of these operating units can be part of the same machine 1.

The oven 2 is a conventional infrared heating oven, the structure and functionality of which are well known to those skilled in the art, and comprises a substantially elliptical path along which the preforms, associated with special mandrels, are brought at infrared heating modules.

The blowing unit 3 is also of the conventional type and comprises a carousel 5 which rotatingly supports a plurality of blowing modules 6, each consisting of two openable and reclosable half-molds, in which the heated preform is housed and inside the neck of which pressurized air is introduced until the bottle is formed. In some cases, these blowing modules 6 can comprise a rod vertically movable inside the preform, so as to obtain a stretch-blowing of the bottle. As said, this machine and this procedure are widely known to those skilled in the art, and therefore require no further description.

Figure 2A:
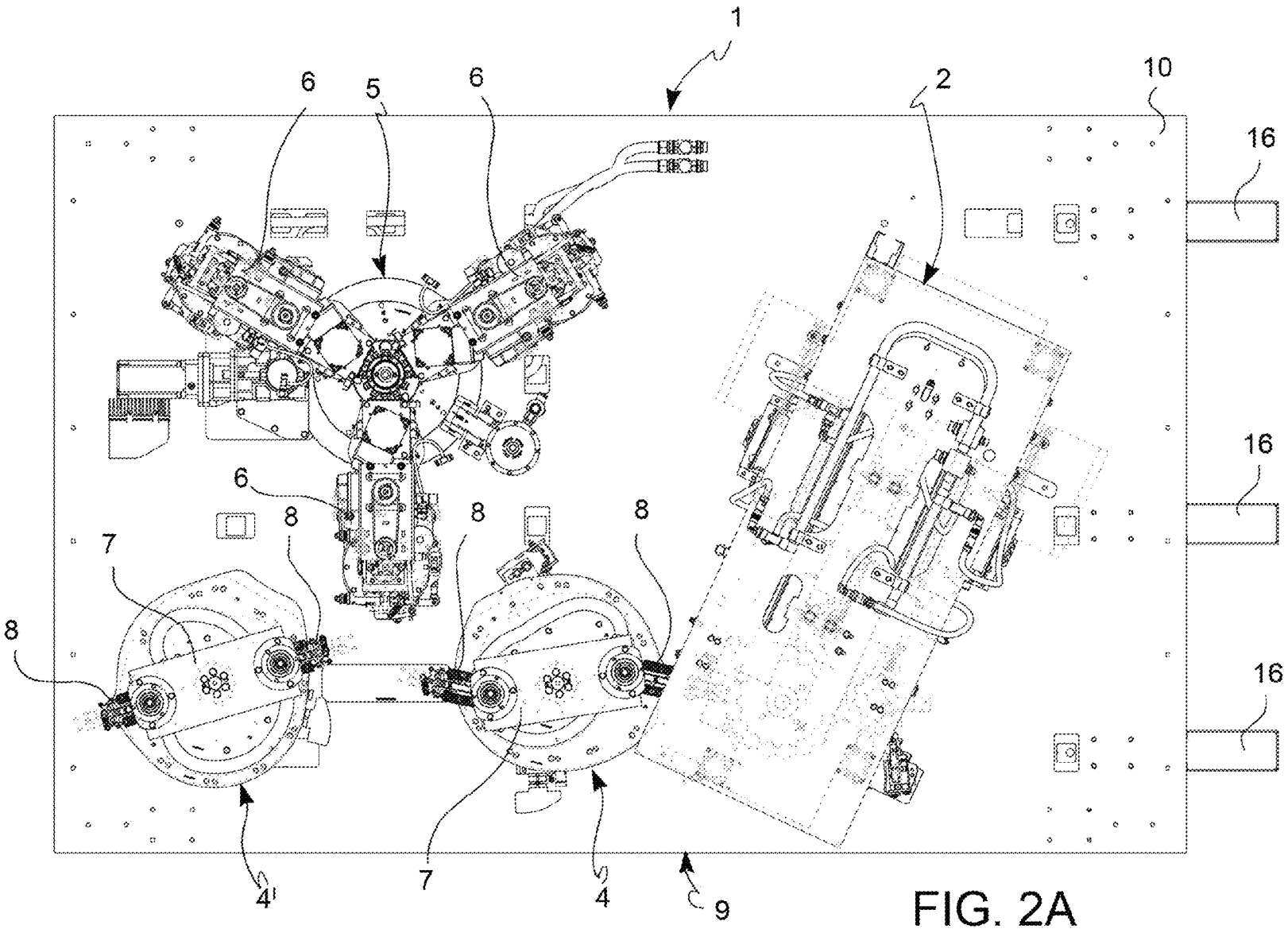
FIG. 2A depicts a top plan view of the machine of FIG. 1.
Figure 2B:
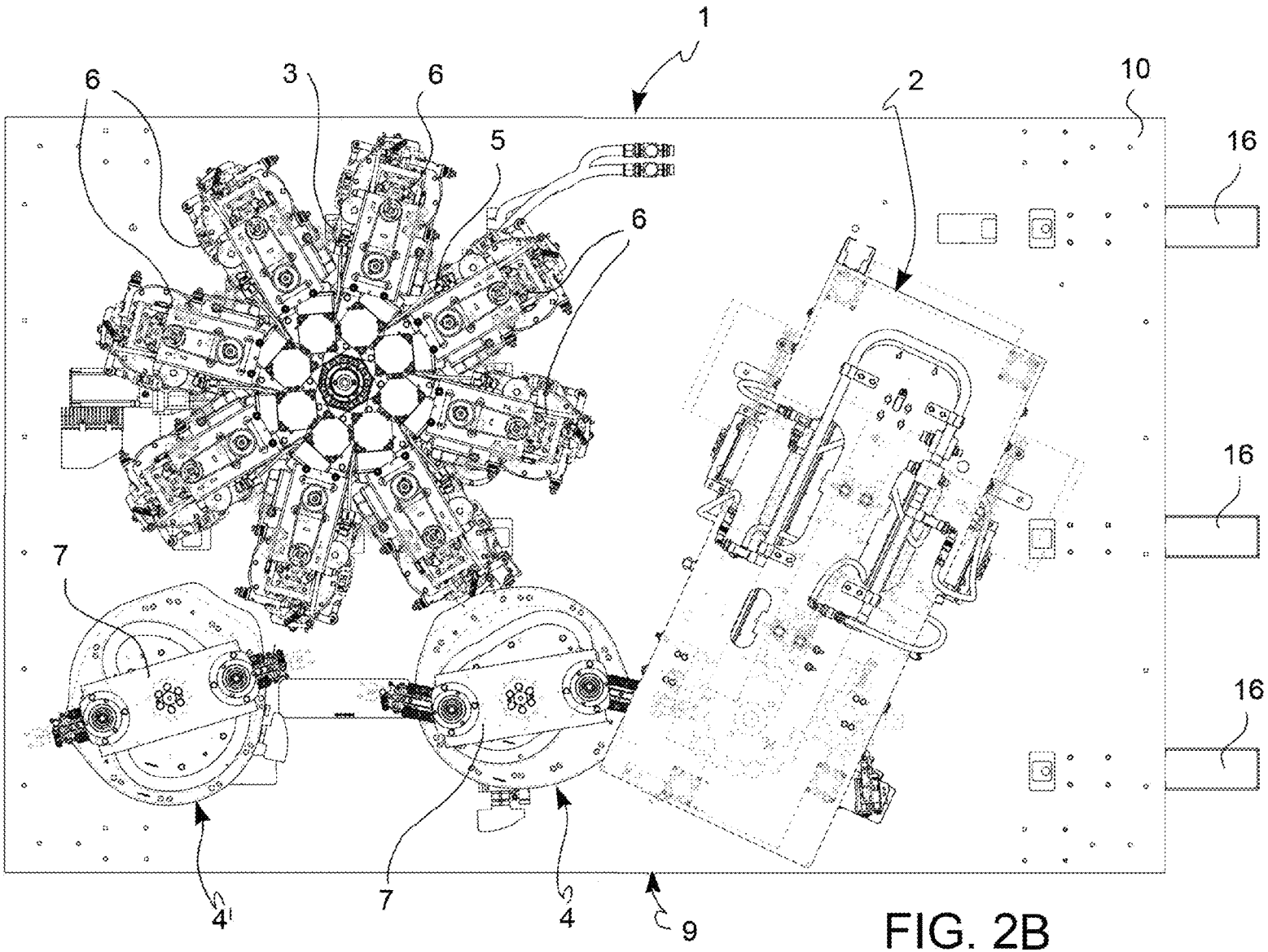
FIG. 2B depicts a top plan view of a variant of the machine of FIG. 1.
Figures 3A, 3B:
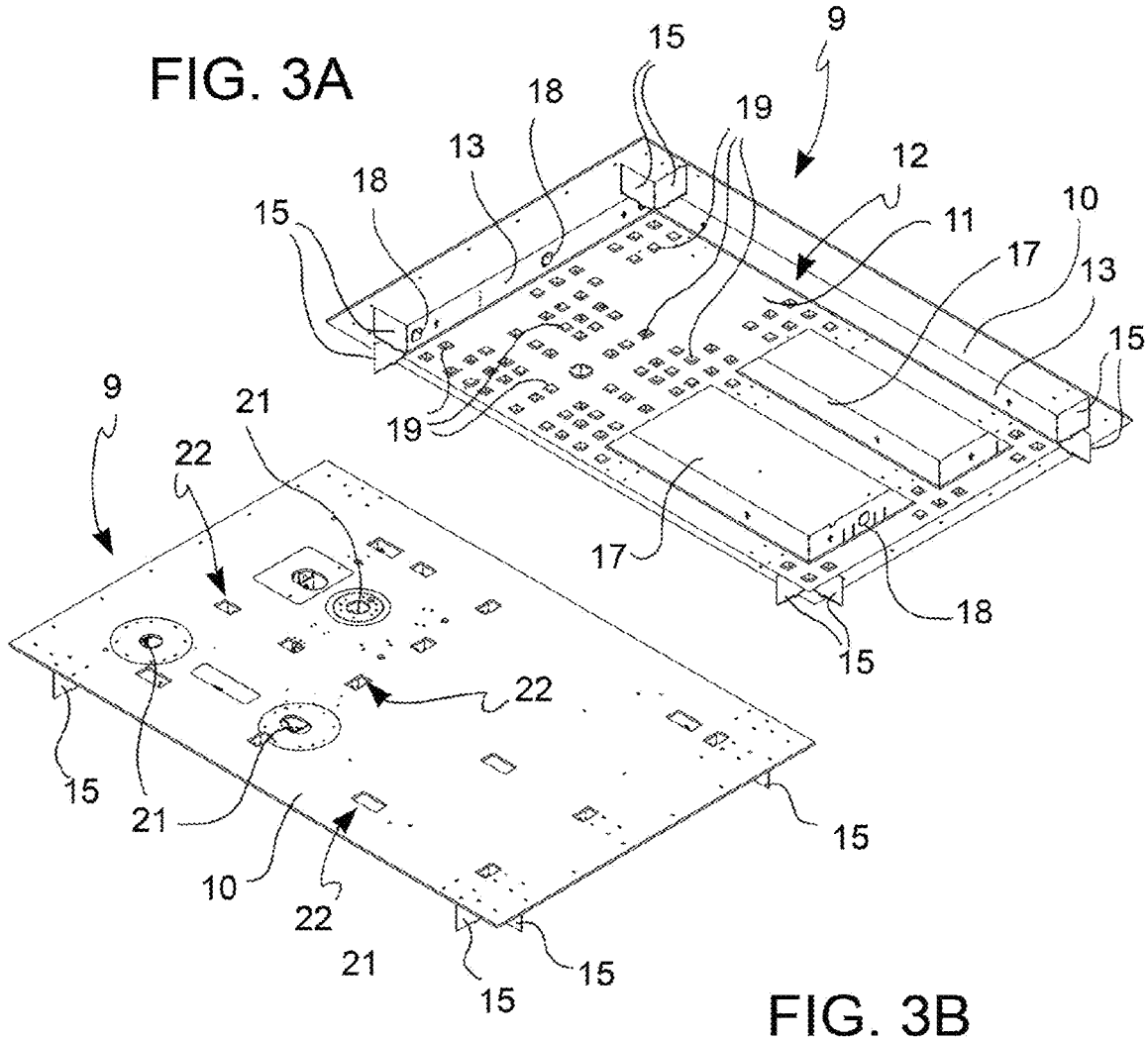
FIG. 3A depicts a bottom perspective view of the base of the machine of FIG. 1.
FIG. 3B depicts a top view of the base of the machine of FIG. 1.
Figure 5:
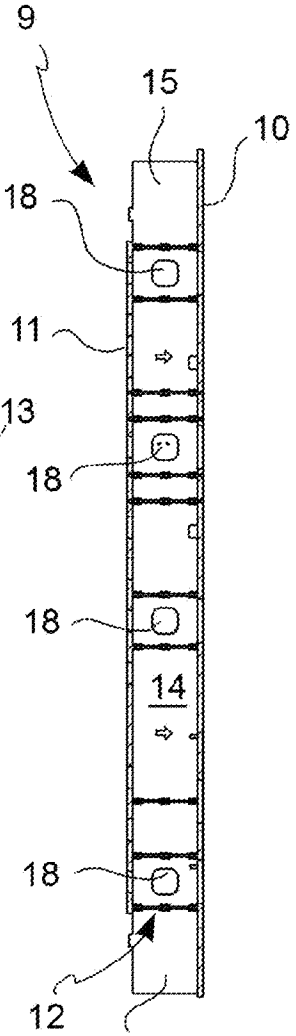
FIG. 5 depicts a view according to section A-A of FIG. 4.
Figure 4:
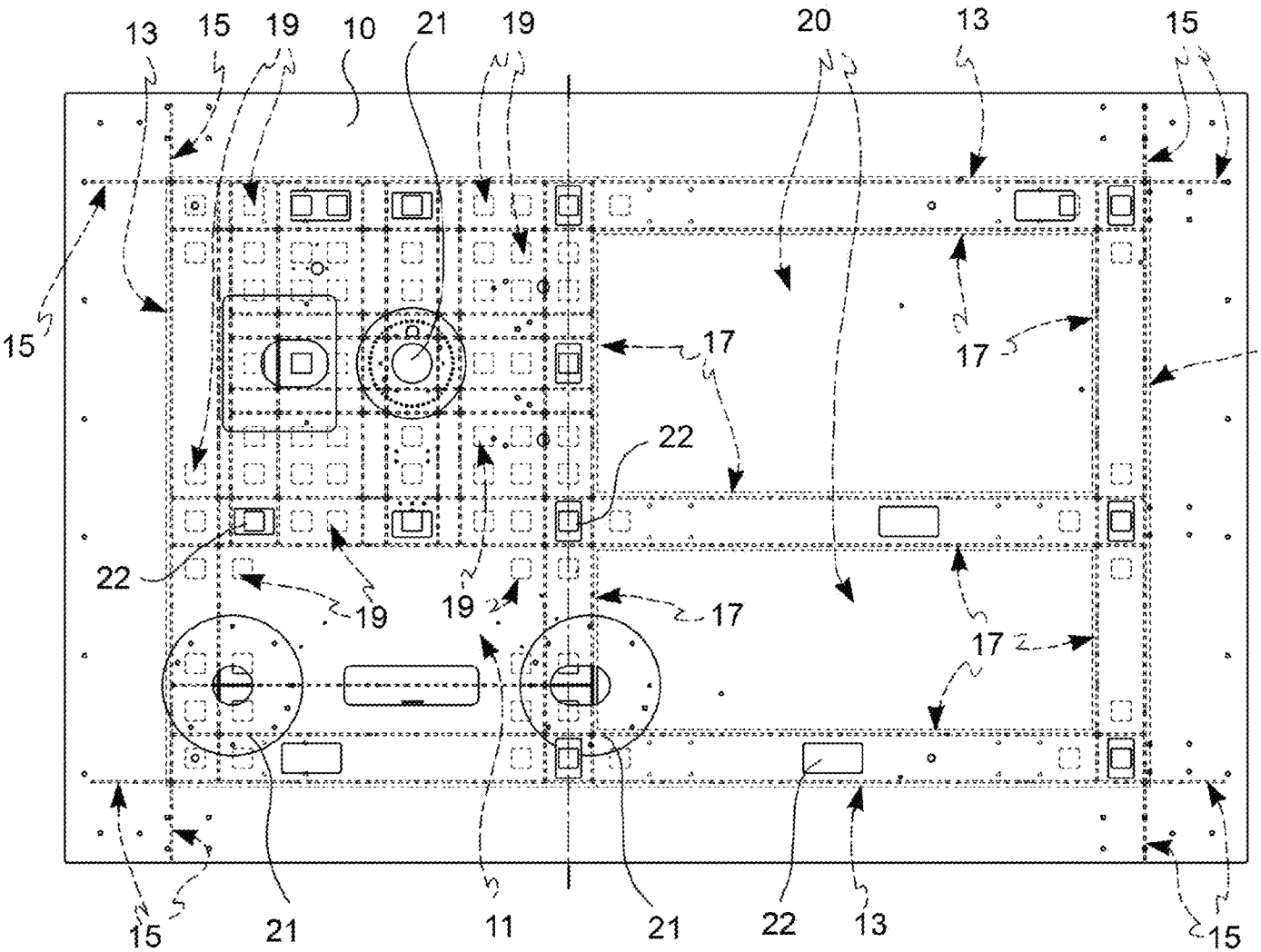
FIG. 4 depicts a top plan view in transparency of the base of FIG. 3.

FIGS. 2A and 2B show two different versions of the machine 1, the only difference of which is the number of blowing modules 6 present on the carousel 5. The number of blowing modules 6 and therefore the size of the carousel 5 will be determined based on the production line needs.

The distribution starwheels 4, 4' are also of known type and comprise a rotating table 7 on which grippers 8 are placed for gripping and transporting the preforms or bottles. The grip occurs as usual below the finishing element of the container neck.

The machine 1 comprises a base 9, which in FIG. 1 is only partially visible, which houses all the operating units on a single plate, which is said upper plate 10.

The base 9, shown in the entirety thereof in FIGS. 3A, 3B, 4 and 5, comprises an upper plate 10 and a lower plate 11, assembled to form a box-like structure 12. In addition to the upper 10 and lower 11 plates, the box-like structure 12 is also formed by four sides 13, arranged along a substantially rectangular profile, which separate the upper plate 10 from the lower plate 11 so as to enclose a space 14 therein which can enclose service cables or pipes functional to the operation of the machine 1.

The upper plate 10 has larger dimensions than the lower plate 11, whereby it protrudes laterally with respect to the four sides 13. Fins 15 extend at the corners of the box-like structure 12 as a continuation of the sides 13, the fins 15 acting as a reinforcement for the ends of the upper plate 10 and as abutment surfaces for support bars 16 of the base 9.

The box-like structure 12 comprises compartments 20 open on the side of the lower plate 11 and closed at the top by the upper plate 10 and laterally by walls 17. The compartments 20 have the function of accommodating and allowing the passage of cables and pipes functional to the operation of the machine.

Both the sides 13 of the box-like structure 12 and the walls 17 of the compartments 20 comprise openings 18 which allow the passage of pipes and cables from the exterior to the interior of the box-like structure 12.

In addition to accommodating the openings of the compartments 20, the lower plate 11 comprises a plurality of service openings 19, arranged in prefixed positions and configured to allow to introduce for example the torch of a welding machine or other tools required for fixing the operating units to the upper plate 10 to access from below the lower surface of the upper plate 10.

The upper plate 10 comprises fixing seats 21 for the various operating units, in the specific example of the figures they are fixing seats 21 for the oven 2, for the carousel 3 and for the distribution starwheels 4, 4'. The fixing seats 21 are arranged in a predefined position, determined by the geometry of the machine 1.

The upper plate 10 in turn comprises a plurality of openings 22 for the passage of cables and pipes functional to the operation of the machine.

As said, the machine 1 shown in the figures is only an example. In fact, machines comprising only the filling, capping and labeling step, or complete machines which include the various processes, i.e., oven for heating the preforms, blowing, optionally washing the formed bottles, filling, capping and labeling, can be obtained. For example, a machine can be obtained comprising a blowing unit, a filling unit, a labeling unit and systems for transporting the containers between said operating units. The feature of the invention is that all the operating units are placed on a single base as described above. However, it will be preferable, for structural reasons, that the base 9 has a maximum size of 3 meters in width and/or 10 meters in length.

The main advantages of the invention are:

- it creates the passages of the cables and pipes directly inside the base, and creates exit holes only where they are needed, this allows to have machine linearity and cleanliness,
- remarkable speed and practicality in moving and installing the machine,
- having a very rigid structure, since there are no screwed components,
- having a single base to process with machine tools, once the components have been positioned, without the need for adjustments,
- possibility of housing from 2 to 16 molds, so as to produce bottles from 0.05 l to 12 l.

It is apparent that only some particular embodiments of the present invention have been described, to which those skilled in the art will be able to make all changes required to adapt it to particular applications, without departing from the scope of protection of the present invention.

What I claim is:

1. A machine for packaging liquids in containers, comprising:

- operating units comprising a preform oven and a blowing unit, and
- distribution starwheels for moving preforms or the containers between the operating units;
- wherein the machine comprises a base which comprises an upper plate including a bottom surface and a lower plate including a top surface, wherein all the operating units and the distribution starwheels are placed on said upper plate, wherein the upper plate and the lower plate are assembled to form a box-like structure, the box-like structure comprising sides which separate the upper plate from the lower plate so as to enclose a space therein on all sides, and configured to accommodate cables and pipes which are functional to operation of the machine, wherein the box-like structure comprises one or more compartments which are open on a side of the lower plate and closed at a top by the upper plate and laterally by walls, the compartments being configured to accommodate and allow passage of the cables and pipes which are functional to the operation of the machine, the walls of the compartments comprising openings configured to allow the passage of the cables and pipes between an exterior and an interior of the box-like structure, wherein the upper plate is larger than the lower plate, whereby the upper plate protrudes laterally with respect to the sides of the box-like structure, wherein fins extend from the sides of the box-like structure between the bottom surface of the upper plate and the top surface of the lower plate, wherein the fins protrude laterally with respect to the sides of the box-like structure and are in contact with and support ends of the bottom surface of the upper plate that protrude laterally with respect the sides of the box-like structure, and wherein the fins are abutment surfaces for support bars of the base.

2. The machine according to claim 1, wherein the lower plate comprises a plurality of service openings, arranged in prefixed positions and configured to allow a torch of a welding machine or other tools required for fixing the operating units to the upper plate to access the operating units from below the bottom surface of the upper plate.

3. The machine according to claim 1, wherein the upper plate comprises:

fixing seats for the operating units and for the distribution starwheels, the fixing seats being arranged in a predefined position determined by geometry of the machine, and a plurality of openings configured for the passage of the cables and pipes which are functional to the operation of the machine.

4. The machine according to claim 1, wherein the base has a maximum size of 3 meters in width and/or 10 meters in length.

5. The machine according to claim 1, wherein said blowing unit comprises two to sixteen blowing modules.

6. A machine for packaging liquids in containers, comprising:

operating units comprising a preform oven, a blowing unit, a filling unit, and a labeling unit, and systems for transporting the containers between said operating units;

wherein the machine comprises a base which comprises an upper plate including a bottom surface and a lower plate including a top surface, wherein all the operating units and the systems for transporting the containers are placed on said upper plate, wherein the upper plate and the lower plate are assembled to form a box-like structure, the box-like structure comprising sides which separate the upper plate from the lower plate so as to enclose a space therein on all sides, and configured to accommodate cables and pipes which are functional to operation of the machine, wherein the box-like structure comprises one or more compartments which are open on a side of the lower plate and closed at a top by the upper plate and laterally by walls, the compartments being configured to accommodate and allow passage of the cables and pipes which are functional to the operation of the machine, the walls of the compartments comprising openings configured to allow the passage of the cables and pipes between an exterior and an interior of the box-like structure, wherein the upper plate is larger than the lower plate, whereby the upper plate protrudes laterally with respect to the sides of the box-like structure, wherein fins extend from the sides of the box-like structure between the bottom surface of the upper plate and the top surface of the lower plate, wherein the fins protrude laterally with respect to the sides of the box-like structure and are in contact with and support ends of the bottom surface of the upper plate that protrude laterally with respect the sides of the box-like structure, and wherein the fins are abutment surfaces for support bars of the base.

7. The machine according to claim 6, wherein the lower plate comprises a plurality of service openings, arranged in prefixed positions and configured to allow a torch of a welding machine or other tools required for fixing the operating units to the upper plate to access the operating units from below the bottom surface of the upper plate.

8. The machine according to claim 6, wherein the upper plate comprises:

fixing seats for the operating units and for the systems for transporting the containers, the fixing seats being arranged in a predefined position determined by geometry of the machine, and a plurality of openings configured for the passage of the cables and pipes which are functional to the operation of the machine.

9. The machine according to claim 6, wherein the base has a maximum size of 3 meters in width and/or 10 meters in length.

10. The machine according to claim 6, wherein said blowing unit comprises two to sixteen blowing modules.

* * * * *